US007908694B1

(12) United States Patent
Sloane et al.

(10) Patent No.: US 7,908,694 B1
(45) Date of Patent: Mar. 22, 2011

(54) MATTRESS COVER APPARATUS WITH INTEGRATED SEALS

(76) Inventors: Robert Sloane, Boca Raton, FL (US); Todd Rosenblatt, Boca Raton, FL (US)

( * ) Notice: Subject to any disclaimer, the term of this patent is extended or adjusted under 35 U.S.C. 154(b) by 7 days.

(21) Appl. No.: 12/555,881

(22) Filed: Sep. 9, 2009

Related U.S. Application Data

(60) Provisional application No. 61/099,605, filed on Sep. 24, 2008.

(51) Int. Cl.
*A47C 20/00* (2006.01)

(52) U.S. Cl. ..... 5/724; 5/737; 5/699

(58) Field of Classification Search ..... 5/699, 724, 5/706, 737, 738, 484; 277/634, 640
See application file for complete search history.

(56) References Cited

U.S. PATENT DOCUMENTS

| | | | | |
|---|---|---|---|---|
| 1,691,629 | A * | 11/1928 | Kusterle | 5/724 |
| 3,372,407 | A * | 3/1968 | Weber, III | 5/724 |
| 4,185,341 | A * | 1/1980 | Scales | 5/699 |
| 6,223,369 | B1 * | 5/2001 | Maier et al. | 5/713 |
| 6,351,864 | B1 * | 3/2002 | Karafa et al. | 5/733 |
| 2007/0283498 | A1 * | 12/2007 | Shelby | 5/706 |

* cited by examiner

*Primary Examiner* — Michael Trettel
(74) *Attorney, Agent, or Firm* — Gold & Rizvi, P.A.; Glenn E. Gold; H. John Rizvi

(57) ABSTRACT

A sealed mattress cover assembly (100) is fabricated having a plurality of seal assemblies (110) disposed upon a mattress cover (102). The mattress cover (102) is formed having a top sheet (103) a bottom sheet (104) and a side sheet (105) extending between the two. An opening (closed via a cover closure (106)) is incorporated within the mattress cover (102) allowing the cover to be placed over the mattress. The seal assemblies (110) are formed having an outer frame (112), an inner frame (120) and a seal membrane (114) sandwiched between the two frame members. A seal aperture (116) is formed in the center of the seal membrane (114). Functionality interfacing conduits (108) are placed through the seal aperture (116), allowing the seal membrane (114) to form a seal about the exterior of the conduits (108).

20 Claims, 4 Drawing Sheets

MATTRESS COVER APPARATUS WITH INTEGRATED SEALS

CROSS-REFERENCE TO RELATED APPLICATION

This Non-Provisional Utility application claims the benefit of U.S. Provisional Patent Application Ser. No. 61/099,605, filed on Sep. 24, 2008, which is incorporated herein in its entirety.

BACKGROUND OF THE INVENTION

1. Field of the Invention

The present invention relates to a mattress cover apparatus in general, and more particularly to a mattress cover apparatus comprising seals for mattress control conduits.

2. Discussion of the Related Art

Mattress covers generally provided to protect a mattress from any of a variety of contaminants such as dirt and dust, bodily fluids, microorganisms, and the like. Once a mattress is contaminated with microorganisms such as bedbugs, the mattress is generally considered unsanitary and thus discarded.

Bed covers are generally known for common mattresses. The inventor fabricates and distributes mattress covers as a business. The current mattress covers are formed in the fitted shape of the mattress, having a closure providing a means for placing the cover encasing the mattress.

A portion of beds utilizes a mattress that interfaces with a power source or a pneumatic source. Some examples include hospital beds, waterbeds, and air-adjustable mattresses. The means for controlling the functionality is provided via a functionality interfacing conduit, such as an electrical wire, a pneumatic line, and the like. The current mattress covers fail to provide a means for ensuring that mattresses having these types of functionality interface conduits are protected from microorganisms.

An elastomer is a polymer with the property of elasticity. The term, which is derived from elastic polymer, is often used interchangeably with the term rubber, and is preferred when referring to vulcanisates. Each of the monomers that link to form the polymer is usually made of carbon, hydrogen, oxygen and/or silicon. Elastomers are amorphous polymers existing above their glass transition temperature, so that considerable segmental motion is possible. At ambient temperatures rubbers are thus relatively soft (E~3 MPa) and deformable.

Thus, what is desired is a means for protecting a mattress that interfaces with conduits from microorganisms using an inexpensive mattress cover.

SUMMARY OF THE INVENTION

The present invention is directed to a mattress cover apparatus, more specifically a mattress cover apparatus comprising:

- a mattress cover having a top sheet, a bottom sheet and a side sheet contiguous disposed between said top sheet and said bottom sheet;
- a cover closure assembled to the mattress cover providing closure to a mattress insertion opening in said mattress cover;
- at least one functional conduit passageway provided through the mattress cover; and
- a pliant seal fabricated of a pliant material and having a port formed through the plaint material, the port having a cross section that is smaller than an interfacing conduit, wherein the pliant seal is assembled to the mattress cover covering the conduit passageway.

One aspect of the present invention utilizes a pliant material fabricated of an elastomeric material, rubber or rubber-like material, a nylon material, and the like.

Another aspect of the present invention assembles the pliant seal to the mattress cover sandwiching the pliant material between a seal outer frame and a seal inner frame.

While another aspect assembles the outer frame and inner frame using a plurality of frame assembly pins affixed to one frame member and respective pin receiving apertures provided in the opposing frame member.

In another aspect deforms each frame assembly pin, securing the frame assembly pins in the respective pin receiving aperture.

Yet another aspect teaches the assembly of a mattress functionality interfacing conduit through a seal aperture, forming a sealed barrier between the exterior of the mattress cover and the interior of the mattress cover.

And another aspect utilizes a zipper, a dense hook and loop tape (commonly referred to as VELCRO), a tie or series of ties, and the like as the cover closure.

Wherein another aspect provides a waterproof lining applied to an interior side of the mattress cover material.

These and other features, aspects, and advantages of the invention will be further understood and appreciated by those skilled in the art by reference to the following written specification, claims and appended drawings, which follow.

BRIEF DESCRIPTION OF THE DRAWINGS

For a fuller understanding of the nature of the present invention, reference should be made to the accompanying drawings in which.

Like reference numerals refer to like parts throughout the several views of the drawings.

DETAILED DESCRIPTION OF REPRESENTATIVE EMBODIMENTS

Figure 1:
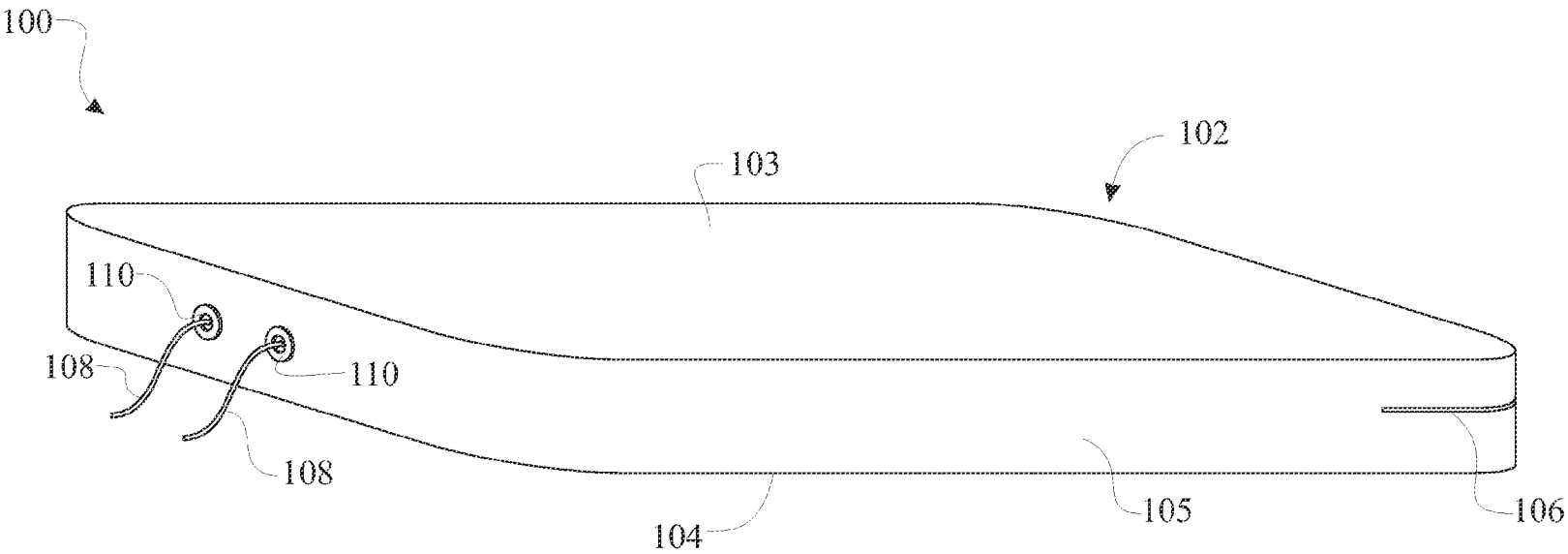
FIG. 1 illustrates an isometric view presenting a mattress cover incorporating a pair of exemplary seal assemblies.
Figure 2:
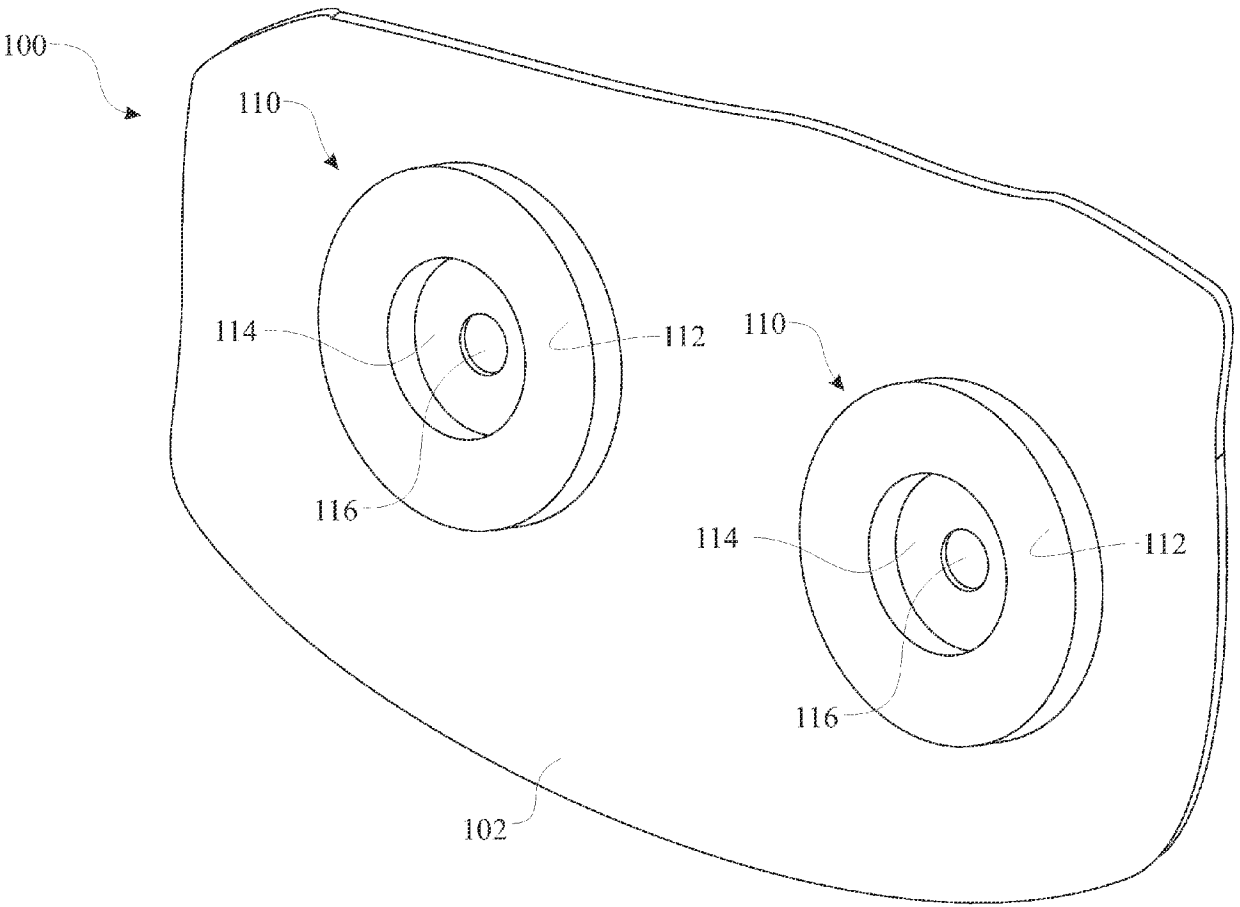
FIG. 2 illustrates a magnified isometric view of the pair of exemplary seal assemblies originally illustrated in FIG. 1.
Figure 3:
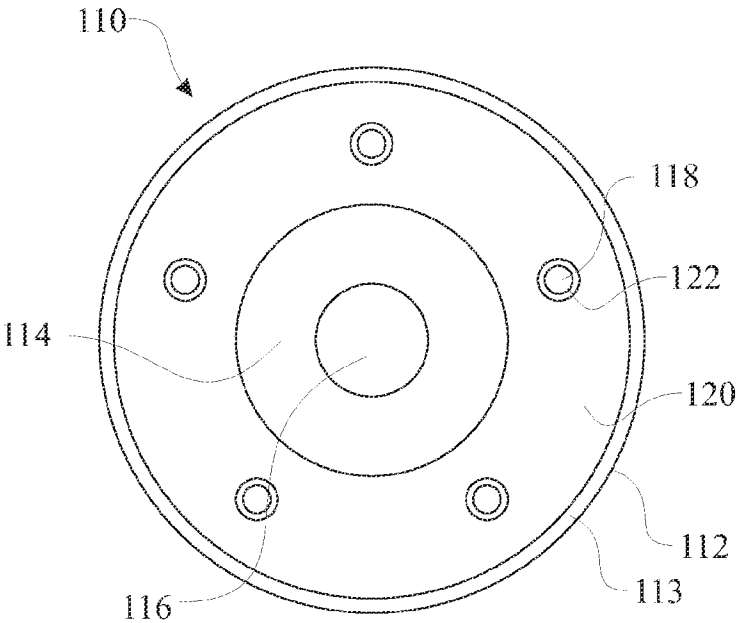
FIG. 3 illustrates a rear view of the exemplary seal assembly originally illustrated in FIG. 1.
Figure 4:
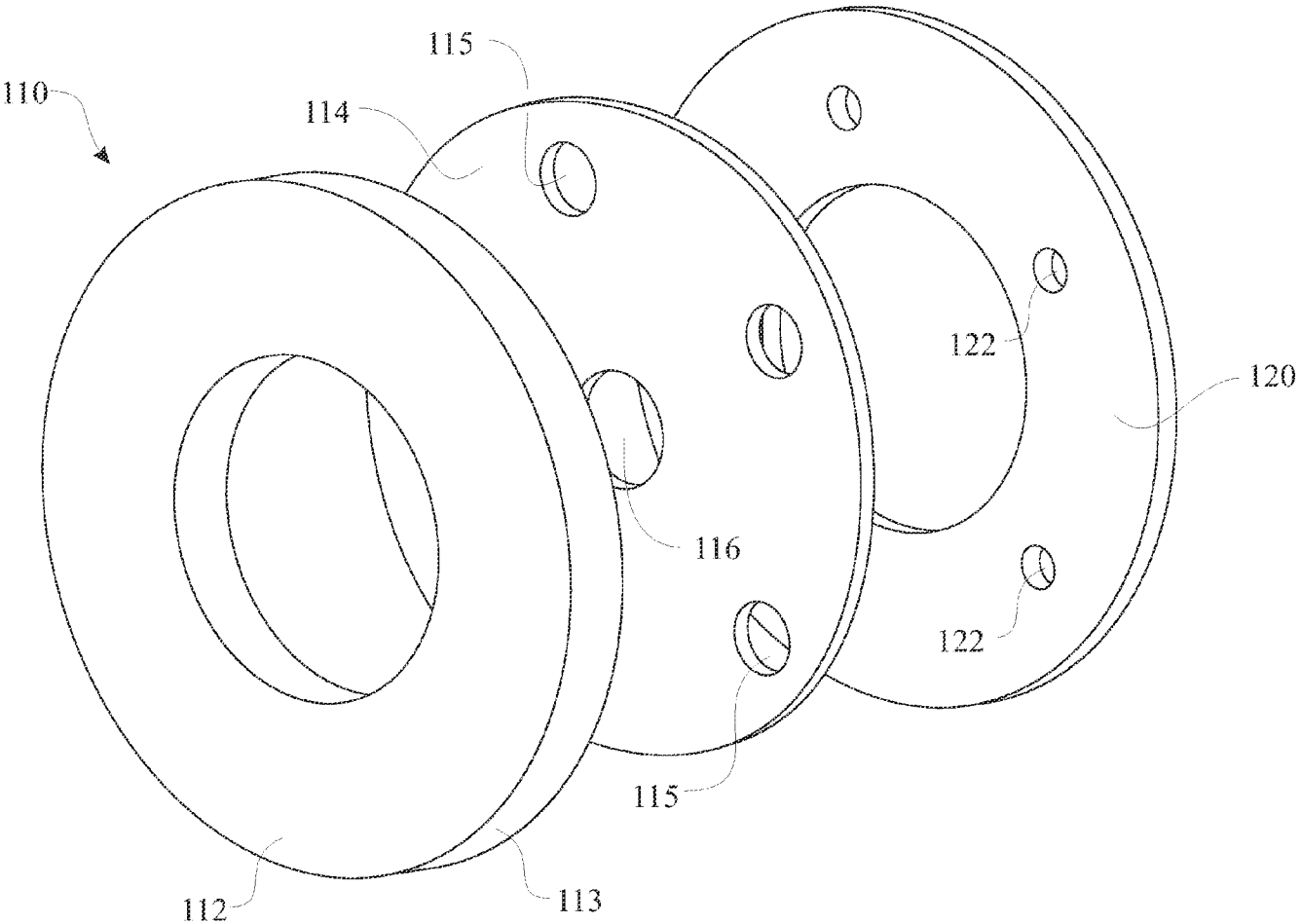
FIG. 4 illustrates an isometric assembly view of the exemplary seal assembly originally illustrated in FIG. 1.

For purposes of description herein, the terms "upper", "lower", "left", "rear", "right", "front", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Turning to the drawings, FIGS. 1 through 4 present various views of an exemplary embodiment of the present invention referred to as a sealed mattress cover assembly 100. The sealed mattress cover assembly 100 is presented in an installed configuration installed in FIG. 1. The sealed mattress cover assembly 100 comprises a mattress cover 102 having at least one seal assembly 110 assembled thereon. The mattress cover 102 is fabricated having a cover top sheet 103, a cover bottom sheet 104, and a cover side sheet 105 assembled there between a perimeter of the cover top sheet 103 and a perimeter of the cover bottom sheet 104 forming a hollow cavity for receiving a mattress. The cover sheet material preferably incorporates a waterproof or microorganism barrier. For comfort, it is preferred to integrate the barrier on the interior surface of the mattress cover 102. The interface between each member is provided via a seam. The seam is formed in a manner that provides a barrier for any microorganisms. One such means would be a thermal bonding process. A second such means would be incorporation of an adhesive between the two sheets of material. A mattress insertion opening is provided within the mattress cover 102 and sealed via a mattress cover closure 106 that is assembled to the mattress cover 102 about the mattress insertion opening. The mattress insertion opening would be sized to allow the user to place the mattress cover 102 over a mattress.

The seal assembly 110 comprises a seal outer frame 112 and a seal inner frame 120 sandwiching a seal membrane 114 there between. The seal membrane is preferably of a pliant material such as silicone. The seal outer frame 112 is preferably formed in a substantially flat donut or ring shape as illustrated. A plurality of frame assembly pins 118 extends rearward from a mating surface (rear as shown) of the seal outer frame 112. The seal inner frame 120 is also preferably formed in a substantially flat donut or ring shape as illustrated. A plurality of pin receiving apertures 122 is formed through the seal inner frame 120 in a pattern aligning with the plurality of the frame assembly pins 118. The seal outer frame 112 and seal inner frame 120 would be formed of a material that is compatible with he selected assembly process. A seal aperture 116 and a plurality of pin clearance apertures 115 disposed through the seal membrane 114. During the installation process, the installer would slide each mattress functionality interfacing conduit 108 through the seal aperture 116. The seal membrane 114 forms a microorganism barrier surrounding the mattress functionality interfacing conduit 108.

A sandwiching assembly is presented as an exemplary means for assembling the seal assembly 110; the embodiment places the plurality of frame assembly pins 118 through the pin clearance apertures 115, and assembled through the plurality of pin receiving apertures 122. The frame assembly pins 118 are secured within the pin receiving apertures 122 via any commonly known process, such as heat staking, ultrasonic welding, and the like. The cover material would have holes similar to the seal membrane 114 and would be placed on either side of the seal membrane 114 during the assembly of the seal assembly 110. The preferred embodiment positions the cover material between the seal membrane 114 and the seal inner frame 120. The seal outer frame 112 can include a frame registration lip 113 extending rearward from the perimeter of the seal outer frame 112 to a distance sufficient for the insertion of the mattress material, the seal membrane 114, and the seal inner frame 120. The frame registration lip 113 aids in alignment and retention of the seal inner frame 120. It is well understood that other assembly processes can be utilized, while maintaining the spirit and intent of the present invention.

The mattress functionality interfacing conduit 108 normally provides an easy path for microorganisms to contaminate a mattress. The sealed mattress cover assembly 100 provides a microorganism barrier surrounding the mattress, including a means providing a barrier around items such as the mattress functionality interfacing conduit 108. The present invention significantly reduces the risk of having to discard a mattress due to contamination.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

We claim:

1. A mattress cover apparatus, more specifically the mattress cover apparatus comprising:

a mattress cover having a top sheet, a bottom sheet and a side sheet contiguous disposed between said top sheet and said bottom sheet;

a cover closure assembled to the mattress cover providing closure to a mattress insertion opening in said mattress cover;

at least one functional conduit passageway provided through the mattress cover; and a pliant seal fabricated of a pliant material and having a port formed through the plaint material, the port having a cross section that is smaller than an interfacing conduit, wherein the pliant seal is assembled to the mattress cover covering the conduit passageway for keeping contaminants from passing through a conduit-mattress cover interface.

2. A mattress cover apparatus as recited in claim 1, wherein the pliant material is assembled to the mattress cover via a ring shaped seal frame.

3. A mattress cover apparatus as recited in claim 2, wherein the ring shaped seal frame comprises a seal outer frame and a seal inner frame, wherein the pliant material is sandwiched between the outer frame and the inner frame.

4. A mattress cover apparatus as recited in claim 3, the a seal outer frame further comprising a pattern of pins extending from an assembly side of the seal outer frame; and the seal inner frame comprising a pattern of pin receiving apertures provided therethrough, wherein the pattern of pins corresponds to the pattern of apertures, wherein the seal outer frame and the seal inner frame are assembled via inserting the pattern of pins through the pattern of apertures.

5. A mattress cover apparatus as recited in claim 4, the pliant material further comprising a pattern of pin clearance apertures, wherein the pattern of pin clearance apertures corresponds to the pattern of pins;

wherein the pattern of pins are inserted through the pattern of pin clearance apertures of the pliant material sandwiching the pliant material between the outer frame and the inner frame.

6. A mattress cover apparatus as recited in claim 3, wherein the seal outer frame further comprises a lip extending outward from an assembly side of the seal outer frame and sized to cover a perimeter of the seal inner frame.

7. A mattress cover apparatus as recited in claim 1, the mattress cover further comprising a mattress inserted within the mattress cover, the mattress comprising an adjusting mechanism operated by at least one controller interface conduit, the controller interface conduit being inserted through the port formed through the plaint material.

8. A mattress cover apparatus, more specifically the mattress cover apparatus comprising:

a mattress cover having a top sheet, a bottom sheet and a side sheet contiguous disposed between said top sheet and said bottom sheet;

a mattress cover closure integrated with the mattress cover providing a resealable access for inserting a mattress therein;

a plurality of functional conduit passageways provided through the mattress cover; and a plurality of pliant seals fabricated of a pliant material and having a port formed through the plaint material, the port having a cross section that is smaller than an interfacing conduit, wherein the pliant seals are assembled to the mattress cover covering each the conduit passageways for keeping contaminants from passing through a conduit-mattress cover interface.

9. A mattress cover apparatus as recited in claim 7, wherein the pliant material is assembled to the mattress cover via a ring shaped seal frame.

10. A mattress cover apparatus as recited in claim 8, wherein the ring shaped seal frame comprises a seal outer frame and a seal inner frame, wherein the pliant material is sandwiched between the outer frame and the inner frame.

11. A mattress cover apparatus as recited in claim 9, the a seal outer frame further comprising a pattern of pins extending from an assembly side of the seal outer frame; and the seal inner frame comprising a pattern of pin receiving apertures provided therethrough, wherein the pattern of pins corresponds to the pattern of apertures, wherein the seal outer frame and the seal inner frame are assembled via inserting the pattern of pins through the pattern of apertures.

12. A mattress cover apparatus as recited in claim 10, the pliant material further comprising a pattern of pin clearance apertures, wherein the pattern of pin clearance apertures corresponds to the pattern of pins;

wherein the pattern of pins are inserted through the pattern of pin clearance apertures of the pliant material sandwiching the pliant material between the outer frame and the inner frame.

13. A mattress cover apparatus as recited in claim 9, wherein the seal outer frame further comprises a lip extending outward from an assembly side of the seal outer frame and sized to cover a perimeter of the seal inner frame.

14. A mattress cover apparatus as recited in claim 1, the mattress cover further comprising a mattress inserted within the mattress cover, the mattress comprising an adjusting mechanism operated by a plurality of controller interface conduits, each controller interface conduit is inserted through a respective port formed through the plaint material.

15. A mattress cover apparatus, more specifically the mattress cover apparatus comprising:

a mattress cover having a top sheet, a bottom sheet and a side sheet contiguous disposed between said top sheet and said bottom sheet;

a mattress cover closure integrated with the mattress cover providing a resealable access for inserting a mattress therein;

at least one functional conduit passageway provided through the mattress cover;

a pliant seal fabricated of a pliant material and having a port formed through the plaint material, the port having a cross section that is smaller than an interfacing conduit, wherein the pliant seal is assembled to the mattress cover covering the conduit passageway for keeping contaminants from passing through a conduit-mattress cover interface; and a mattress inserted through the mattress cover closure, being sealed within the mattress cover when the mattress cover closure is resealed, the mattress comprising an adjusting mechanism in operable communication with an external controller via at least one controller interface conduit, the controller interface conduit being inserted through the port formed through the plaint material.

16. A mattress cover apparatus as recited in claim 15, wherein the pliant material is assembled to the mattress cover via a ring shaped seal frame.

17. A mattress cover apparatus as recited in claim 16, wherein the ring shaped seal frame comprises a seal outer frame and a seal inner frame, wherein the pliant material is sandwiched between the outer frame and the inner frame.

18. A mattress cover apparatus as recited in claim 17, the a seal outer frame further comprising a pattern of pins extending from an assembly side of the seal outer frame; and the seal inner frame comprising a pattern of pin receiving apertures provided therethrough, wherein the pattern of pins corresponds to the pattern of apertures, wherein the seal outer frame and the seal inner frame are assembled via inserting the pattern of pins through the pattern of apertures.

19. A mattress cover apparatus as recited in claim 18, the pliant material further comprising a pattern of pin clearance apertures, wherein the pattern of pin clearance apertures corresponds to the pattern of pins;

wherein the pattern of pins are inserted through the pattern of pin clearance apertures of the pliant material sandwiching the pliant material between the outer frame and the inner frame.

20. A mattress cover apparatus as recited in claim 17, wherein the seal outer frame further comprises a lip extending outward from an assembly side of the seal outer frame and sized to cover a perimeter of the seal inner frame.

* * * * *